US011077568B2

(12) United States Patent
Krauss et al.

(10) Patent No.: US 11,077,568 B2
(45) **Date of Patent: *Aug. 3, 2021**

(54) ELECTRIC SHAVER

(71) Applicant: Braun GmbH, Kronberg (DE)

(72) Inventors: Joachim Krauss, Seeheim-Jugenheim (DE); Cirilo Javier Perez Lopez, Frankfurt am Main (DE); Uwe Ludaescher, Frankfurt am Main (DE); Sebastian Hottenrott, Idstein (DE)

(73) Assignee: Braun GMBH, Kronberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,339

(22) Filed: Sep. 28, 2017

(65) Prior Publication Data

US 2018/0085951 A1 Mar. 29, 2018

(30) Foreign Application Priority Data

| | | |
|---|---|---|
| Sep. 28, 2016 | (EP) | 16191105 |
| Nov. 30, 2016 | (EP) | 16201467 |
| Sep. 26, 2017 | (EP) | 17193115 |

(51) Int. Cl.

| | |
|---|---|
| ***B26B 19/38*** | (2006.01) |
| ***B26B 19/06*** | (2006.01) |
| ***B26B 19/14*** | (2006.01) |
| ***B26B 19/04*** | (2006.01) |

(Continued)

(52) U.S. Cl.

CPC ..... *B26B 19/386* (2013.01); *B26B 19/046* (2013.01); *B26B 19/048* (2013.01); *B26B 19/063* (2013.01); *B26B 19/146* (2013.01); *B26B 19/388* (2013.01); *B26B 19/3826* (2013.01); *B26B 19/3893* (2013.01); *B26B 19/042* (2013.01); *B26B 19/282* (2013.01); *B26B 19/40* (2013.01)

(58) Field of Classification Search

CPC ... B26B 19/048; B26B 19/386; B26B 19/046; B26B 19/3813; B26B 19/48; B26B 19/40; B26B 19/382; B26B 19/3853

See application file for complete search history.

(56) References Cited

U.S. PATENT DOCUMENTS

| | | | | |
|---|---|---|---|---|
| 2,229,972 A * | 1/1941 | Holsclaw | ..... | B26B 19/18 30/43.2 |
| 3,074,161 A * | 1/1963 | Liska | ..... | B26B 19/04 30/346.51 |
| 3,748,371 A | 7/1973 | Krook et al. | | |

(Continued)

FOREIGN PATENT DOCUMENTS

| | | |
|---|---|---|
| AT | 409604 B | 9/2002 |
| CN | 101484282 A | 7/2009 |

(Continued)

OTHER PUBLICATIONS

European search report dated Sep. 12, 2017.

(Continued)

*Primary Examiner* — Jonathan G Riley

(74) *Attorney, Agent, or Firm* — Kevin C. Johnson

(57) ABSTRACT

The present invention relates to electric shavers, handpieces of such shavers and a method of manufacturing such electric shavers. More particularly, the present invention relates to a shaver set comprising a plurality of electric shavers.

13 Claims, 7 Drawing Sheets

(51) Int. Cl.
*B26B 19/28* (2006.01)
*B26B 19/40* (2006.01)

(56) References Cited

U.S. PATENT DOCUMENTS

| | | | | |
|---|---|---|---|---|
| 3,967,374 | A * | 7/1976 | Boiten | B26B 19/04 30/43.92 |
| 4,115,920 | A * | 9/1978 | Ascoli | B26B 19/12 30/43.3 |
| 4,167,060 | A * | 9/1979 | Sakamoto | B26B 19/04 30/43.92 |
| D295,564 | S * | 5/1988 | Iwai | D28/49 |
| 5,189,792 | A * | 3/1993 | Otsuka | B26B 19/046 30/41.6 |
| 5,410,811 | A * | 5/1995 | Wolf | B26B 19/048 30/43.9 |
| 5,606,799 | A * | 3/1997 | Melton | B26B 19/063 30/199 |
| 5,704,126 | A | 1/1998 | Franke et al. | |
| 6,052,904 | A * | 4/2000 | Wetzel | B26B 19/044 30/346.51 |
| 6,226,871 | B1 * | 5/2001 | Eichhorn | B26B 19/048 30/346.51 |
| 6,369,341 | B2 * | 4/2002 | Katsumi | B26B 19/38 200/293.1 |
| 6,378,210 | B1 * | 4/2002 | Bickford | B26B 19/3806 30/122 |
| 7,325,311 | B2 * | 2/2008 | Shimizu | B26B 19/046 30/346.51 |
| 7,426,785 | B2 * | 9/2008 | Ho | B26B 19/265 30/216 |
| 7,513,361 | B1 | 4/2009 | Mills, Jr. | |
| 7,698,820 | B2 * | 4/2010 | Oh | B26B 19/288 30/43.91 |
| 7,841,090 | B2 | 11/2010 | Eichhorn et al. | |
| 8,141,253 | B2 * | 3/2012 | Royle | B26B 19/06 30/34.05 |
| 8,672,504 | B2 * | 3/2014 | Kramer | A47G 19/025 362/154 |
| 2007/0213742 | A1 * | 9/2007 | Callahan | A61B 17/00 606/133 |
| 2007/0245576 | A1 | 10/2007 | Peyser et al. | |
| 2007/0283565 | A1 | 12/2007 | Ho | |
| 2008/0155834 | A1 * | 7/2008 | Li | B26B 19/04 30/210 |
| 2009/0025229 | A1 | 1/2009 | Kappes et al. | |
| 2009/0056139 | A1 * | 3/2009 | Royle | B26B 19/3813 30/34.05 |
| 2010/0175264 | A1 | 7/2010 | Shimizu et al. | |
| 2011/0094107 | A1 * | 4/2011 | Ring | B26B 19/048 30/43.1 |
| 2012/0047754 | A1 | 3/2012 | Schmitt | |
| 2015/0089814 | A1 * | 4/2015 | Marut | F16C 11/10 30/42 |
| 2015/0246454 | A1 * | 9/2015 | Mintz | B26B 19/3873 30/124 |
| 2016/0181901 | A1 | 6/2016 | Kraus et al. | |
| 2017/0120467 | A1 * | 5/2017 | Schmitt | B26B 19/12 |
| 2017/0340085 | A1 * | 11/2017 | Kindermann | A45D 26/00 |

FOREIGN PATENT DOCUMENTS

| | | | |
|---|---|---|---|
| CN | 101489738 | A | 7/2009 |
| CN | 101823266 | | 9/2010 |
| CN | 101823266 | A | 9/2010 |
| CN | 102076469 | A | 5/2011 |
| CN | 102985236 | A | 3/2013 |
| CN | 105643671 | A | 6/2016 |
| EP | 2176042 | A1 | 4/2010 |
| EP | 2435218 | A1 | 4/2012 |
| FR | 1391957 | A | 3/1965 |
| GB | 811207 | A | 4/1959 |
| GB | 2251573 | A | 7/1992 |
| JP | 2001513415 | A | 9/2001 |
| JP | 2009540975 | A | 11/2009 |
| JP | 2011526168 | A | 10/2011 |
| JP | 2016077464 | A | 5/2016 |
| WO | 2015074882 | A1 | 5/2015 |

OTHER PUBLICATIONS

First Search; Chinese Application No. 2017800599039; dated Apr. 3, 2020; Chinese Patent Office; Beijing, China.

International Search Report and Written Opinion of the International Searching Authority; European Application No. PCT/IB2017/055895; dated Mar. 15, 2018; European Patent Office; Rijswijk, Netherlands.

* cited by examiner

ELECTRIC SHAVER

FIELD OF THE INVENTION

The present invention relates to electric shavers and a method of manufacturing such electric shavers. According to one aspect, the present invention relates to a shaver set comprising a plurality of electric shavers each comprising a handle including a housing, a motor received in said housing, a shaver head connected to said handle by means of a support structure mounted to connector elements of said housing, at least one cutter unit provided on said shaver head and having a drivable cutter element and a shear foil, wherein said cutter element is configured to be driven along a cutter oscillation axis by said motor via a drive transmitter connecting said motor to said cutter element.

According to another aspect, the invention relates to a shaver handpiece of such an electric shaver, comprising a handle having a housing, a motor received in said housing, a drive transmitter connected to said motor and including a shaft extending out of said housing from one end thereof, wherein said housing is provided with connector elements for connecting a shaver head to the handle.

The invention also relates to a method of manufacturing such electric shavers, the method comprising: manufacturing, for each of said electric shavers, a housing containing the motor and supporting the drive transmitter, said housings being identical to each other in shape and structure, and having connector elements for connecting a support structure of the shaver heads to the handle.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver.

Although shavers having the motor positioned in the shaver head are known, such type of shavers are disadvantages in several aspects. For example, the shaver head gets additional weight and the entire shaver is no longer balanced, but top-heavy, thus impairing a comfortable handling of the shaver. Additionally, the shaver head becomes rather bulky what makes it sometimes difficult to shave smaller skin portions such as the face portion between the nose and the lips. In contrast, shavers having the motor accommodated in the housing forming the handle provide for a more balanced handling and allow for a more compact, smaller design of the shaver head, thus giving more comfort to users.

However, with such type of shaver having the motor received in the handle, it is sometimes difficult to modify the kinematics of the shaver head to meet with different users' preferences. As it is known, some users prefer self-adapting shaver heads which may move relative to the handle so as to self-adapt to the skin contour, whereas other users prefer to have less flexible, more rigid shaver head structures giving more control to the user. When accommodating the motor in the handle, the drive train connecting the motor in the handle to the cutter units in the shaver head need to have different architectures to efficiently drive the cutter elements of shaver heads with different kinematics. Usually, such drive trains providing for more flexibility allowing the shaver head to pivot and/or swivel, achieve a restricted efficiency only. On the other hand, drive trains providing for more rigidity and thus increase deficiency are usually only usable for shaver heads having only limited degrees of freedom relative to the handle. Therefore, manufacturer usually design different drive train structures for different types of shavers, thereby increasing manufacturing costs.

Irrespective of the architecture of the drive unit and the drive train, the cutter elements, in addition to the aforementioned cutting motion, may be movable in various other directions so as to self-adapt to the contour of the skin to be shaved. For example, the cutter elements may be part of a shaver head that is slewable about one or more axes relative to the handle of the shaver, wherein the support structure connecting the shaver head to the handle may allow the shaver head to swivel about a swivel axis extending substantially parallel to the elongated cutter elements and/or the reciprocating axis thereof. In addition or in the alternative, the supporting structure may allow the shaver head to tilt about a tilting axis extending transverse to the longitudinal axis of the handle and transverse to the elongated cutter elements and/or the reciprocating axis thereof. In addition to or in the alternative to such shaver head movements, the cutter elements may dive into the shaver head and/or the shaver head may dive towards the handle so as to adjust the position relative to the skin contour to be shaved.

To allow for the aforementioned swiveling and/or tilting movements of the shaver head, the support structure may include a so-called four-joint linkage formed by a pair of link arms which are, on the one hand, pivotably mounted to the handle and, on the other hand, pivotably mounted to a shaver head part such as a shaver head frame, wherein the pivotable joints connecting the link arms to the handle and the shaver head, respectively, may define pivot axes parallel to each other and parallel to the tilting or swiveling axis defined by such four-joint linkage. Due to slewing or rotating movements of the link arms, the shaver head may tilt or swivel to adjust its rotatory position to better follow the skin contour.

Such support structures are sometimes rather difficult to be cleaned. Hair dust or hair stubbles from the cutter elements may get stuck on the support structure and neighboring surfaces and may form a cake or deposits in corners and recesses what may impair the movability of the shaver head.

For example, prior art reference US 2010/0175264 A1 shows such four-joint linkage of the shaver head to the handle, wherein the link arms are arranged in a sort of pendulum or hanging arrangement. An interposer part attached to the handle includes two poles projecting upwards into the shaver head, wherein the link arms are pivotably attached to the top end portions of such poles to extend or hang downwards back towards to the handle. The lower end portions of such hanging link arms are pivotably connected to a shaver head frame.

A similar support structure movably connecting the shaver head of an electric shaver to the handle thereof is shown by reference JP 2016-77464 A also showing a four-joint linkage including a pair of hanging link arms.

Another support structure allowing for swiveling and tilting of the shaver head of an electric shaver about swiveling and tilting axes is shown by EP 2 435 218 B1 suggesting a cardan support structure including a shaver head frame pivotably mounted to a cradle-like handle part and, on the other hand, pivotably supporting a cutter frame on which the cutter element is supported.

Furthermore, AT 409604 B shows an electric shaver having cutter elements which may, in addition to the oscillating cutting movements, pivot about an axis perpendicular to the shaver's longitudinal axis and the axis of oscillation of the cutter element so as to allow for adjustment of the cutter element position to the skin to be shaved, and rotatorily oscillate about an axis parallel to the longitudinal axis of the shaver housing. The transmission train connecting the drive motor to the cutter elements includes a coupling structure rotatorily oscillating about a pivot axis parallel to the shaver housing's longitudinal axis.

US 2009/0025229 A1 discloses a drive unit for the cutter elements of an electric shaver, wherein the drive unit includes transmitter pins extending from the shaver housing towards the shaver head, wherein the oscillating driving movements of said transmitter pins are applied onto the cutter elements via an oscillatory bridge supported for oscillatory reciprocation in the shaver head, wherein said oscillatory bridge includes yielding coupling arms so as to allow for adjusting movements of the cutter elements. A similar transmission architecture is known from U.S. Pat. No. 7,841,090 B2.

Moreover, US 2007/0245576 A1 shows a shaver with a blade cartridge carrier that is pivotably supported on top of a handle about a plurality of pivoting axes allowing for multi-axial rotatory movements of the blade cartridge to the skin contour, wherein the cartridge can be removed from said cartridge carrier so as to be replaced by a fresh cartridge. Document CN 101823266 A discloses a shaver with a shaver head tiltable supported relative to the handle by means of a pair of guide pins slideably received within guiding grooves. Furthermore, document U.S. Pat. No. 7,513,361 B1 discloses a set of hair clippers accommodated within a common suitcase and connected via power cords to a common power source.

Further electric shavers allowing for adapting movements of the cutter elements are known from U.S. Pat. No. 3,748,371 B, FR 1391957 A, GB 811,207 B and U.S. Pat. No. 5,704,126 B.

SUMMARY OF THE INVENTION

It is an objective underlying the present invention to provide for an improved electric shaver avoiding at least one of the disadvantages of the prior art and/or further developing the existing solutions. A more particular objective underlying the invention is to provide for cost-sensitive manufacturing of electric shavers fulfilling different preferences of users such as more control of shaver head movements or an easier handling of the shaver not paying attention to exactly positioning the shaver head to the skin contour.

A further objective underlying the invention is to provide for an improved shaver in which tactile properties and handling characteristics are less restrained by mechanical requirements of the housing and drive train.

A still further objective underlying the invention is to achieve an efficient driving of the cutter unit in the shaver head with a simple drive train structure needing a restricted number of parts only.

To achieve at least one of the aforementioned objectives, it is suggested to use the same basic handpiece structure including a drive train to be connected with the cutter units in the shaver head for a plurality of different shaver head structures. The shaver's handpiece forms a functional platform including the drive unit's motor, electronic components and the drive transmitter for connecting the motor to the shaver head's cutter unit, wherein such functional platform is adapted to different needs of different users by means of attaching a variety of shaver heads providing for different kinematics. According to an aspect, housings identical to each other in shape and structure and including identical connector elements are used for different shaver heads and/or different support structures connecting the shaver heads to the corresponding housing, wherein at least two of the following three types of shaver heads and/or support structures can be connected to such one type of housing: a first type of shaver head connected to the handle by means of a first support structure configured to provide for three-dimensional movements of the shaver head relative to the handle, a second type of shaver head connected to the handle by means of a second support structure configured to provide for only two-dimensional movements of the shaver head relative to the handle, and a third type of shaver head connected to the handle by a third support structure configured to rigidly hold the shaver head relative to the handle. Due to the identical structure of the connector elements of all housings matching with any of the support structures of the different shaver heads, the shaver heads may be replaced against each other and each shaver head may be selectively mounted to the housing of all shavers.

Thus, only one type of housing is manufactured, although different types of shaver heads and/or support structures are mounted to such housing.

According to a further aspect, the shaver handpiece has a housing accommodating a motor and rotatably supporting a drive shaft having a shaft portion extending outside of said housing, wherein said housing is provided with connector elements for connecting different types of shaver heads to the housing, wherein said housing includes an inner housing receiving the motor and an outer housing surrounding the inner housing, wherein said connector elements for connecting the shaver head are provided on said inner housing and include pivot joints providing for a pair of pivot axes extending transverse to the longitudinal axis of the drive shaft on opposite sides thereof. Such pivot joints allow for pivotably connecting link arms of a support structure configured to provide for a pivot axis about which the shaver head may pivot or tilt relative to the handle. Nevertheless, such pivot axes of the connector elements do not need to be used, but is also possible to connect a more rigid structure such as a supporting yoke to such connector elements to block tilting movements of the shaver head.

The aforementioned different support structures of the shaver heads having different kinematics may be connected to the same connector elements on the housing of the handle, in particular to the aforementioned pivot axes.

In the alternative, said housing of the handle may have different sets of connector elements for connecting to the different support structures of different shaver heads. In order to achieve a simple structure and a compact, smooth design of the handpiece, it is however possible that the housing of the handle has only set of connector elements to which all different types of shaver heads and the support structures thereof can be connected.

In order to allow for different architectures of the support structures and to avoid collisions of such different support structures with the shaver handpiece, it may help to clearly separate the shaver head from the handle and to avoid interpenetrating or interlacing of shaver head portions into the handle and vice versa. More particularly, the shaver head may be positioned spaced apart from the handle with a gap defined between a bottom face of the shaver head and a top face of the handle, said gap forming a peripheral or circumferential contraction in the outer contour of the shaver around said support structure and giving access to the support structure bridging said gap. Due to such open periphery and separation of the shaver head and the handle from each other, air can be blown onto the support structure or water can be rinsed through the gap to clean the support structure and the bottom surface of the shaver head and/or the handle's top face to remove hair particles and deposits. In addition, such spacing between the shaver head and handle increases the degree of freedom of moving the shaver head relative to the handle without the restrictions of collisions between these two elements, wherein such additional freedom is particularly helpful in tilting an elongated shaver head about a tilting axis perpendicular to the main axis of the elongated shaver head.

Said gap may form a substantially ring-shaped constriction of the shaver body or a housing gap extending between the handle's housing and the shaver head housing or the outer contour of the shaver head, wherein ring-shaped does not necessarily mean a closed circle, but my include other contours such as an oval or elliptical ring which may or may not be closed or may be slotted. Said substantially ring shaped constriction may surround substantially completely a central neck portion. In other words, the shaver body has a neck formed between the handle and the shaver head clearly separating these two components from each other.

According to a further aspect, the electric shaver may provide for a first type of support structure in terms of a pivot linkage(s) and/or a four-joint linkage(s) between the shaver head and the handle to allow the shaver head to swivel and/or tilt relative to the handle, wherein said four-joint linkage includes a pair of link arms each having a head joint pivotably connecting to a shaver head part and a handle joint connecting to the handle or a base part connected to such handle. Such link arms may be uncovered and/or freely accessible via the aforementioned gap, thus allowing easy cleaning of the link arms to maintain movability thereof. If such tilting movement of the entire shaver head is not desired, pivoting of such link arms may be blocked what easily can be achieved by means of locking the pivotable head joints and/or the pivotable handle joints of the aforementioned four-joint linkage. For example, said link arms may be formed as an integral, rigid part of the shaver head frame so they cannot pivot, although they still may be pivotably supported at the housing forming the handle. Nevertheless it should be mentioned that it also would be possible to rigidly connect such link arms or linkage to the handle's housing, for example by means of screwing and/or welding and/or gluing, if no such tilting movements are desired.

More particularly, said pair of link arms may be arranged in a standing configuration with the head joints of the link arms connecting to the shaver head part being further away from the handle than the handle joints of the link arms connecting to the handle or base part.

These and other advantages become more apparent from the following description giving reference to the drawings and possible examples.

DETAILED DESCRIPTION OF THE INVENTION

Figure 1:
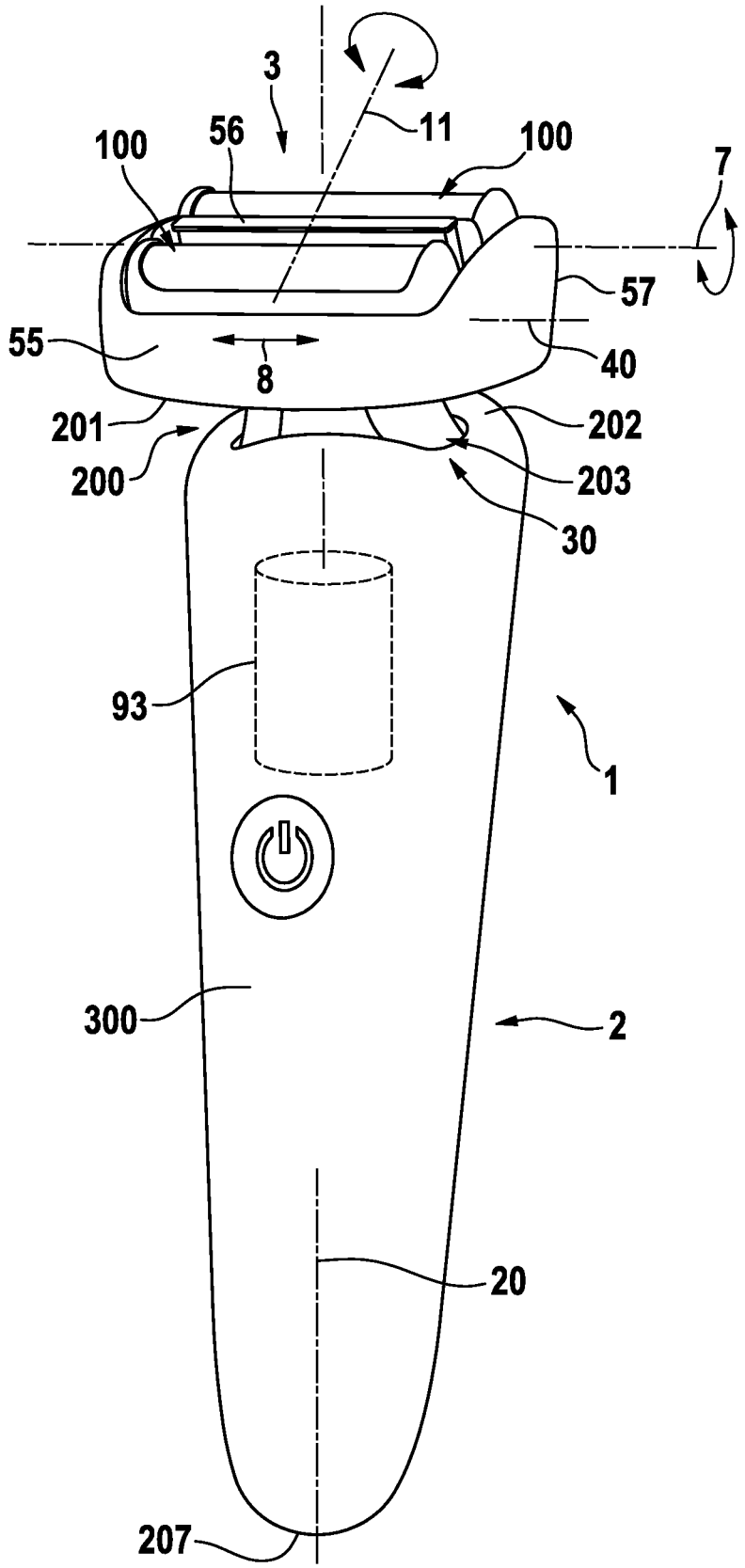
FIG. 1: a perspective view of an electric shaver with a shaver connected to a handle by means of a support structure.

According to an aspect, the handpiece of the various and different shavers is formed as a functional platform having the same structure and contour although different types of shaver heads and support structures thereof are connected to such handpiece. More particularly, such handpiece platform includes a housing receiving a drive unit's motor and rotatably supporting a drive shaft connecting the motor to the shaver head's cutter units, wherein such housing includes connector elements for connecting different types of shaver heads to the housing.

In order to allow for connection to a tiltable shaver head which may tilt about a tilting axis extending substantially transverse to the cutter oscillation axis and the drive train's shaft relative to the handle, such connector elements of the housing may include a pair of pivot joints providing for a pair of pivot axes extending transverse to the longitudinal axis of the drive shaft on opposite sides thereof. "Transverse" does not necessarily mean exactly perpendicular in a mathematical sense, but may be considered to mean at least roughly perpendicular such as 90°±25° or 90°±15°.

The housing may have a multi-shell structure comprising an inner housing in which the motor is received, and an outer housing surrounding said inner housing in a shell-like manner, wherein the aforementioned connector elements are provided on the inner housing so as to achieve a rather direct transmission of forces and torques from the shaver head to the motor support and vice versa, thereby improving driving efficiency. Although the housing includes an outer shell in terms of the aforementioned outer housing surrounding the inner housing, the support structure of the shaver head is not connected to the outer housing, but directly to the inner housing which supports the motor and the shaft which is connected to the motor and includes a shaft portion extending outside the housing towards the shaver head. Thus, the outer housing may be designed to meet users' tactile preferences without being restricted by the supporting function of the housing.

The inner housing may form a sealed, in particular water-proof container in which the motor, batteries or accumulators or other power sources and an electronic control unit for controlling the motor are received and protected against liquids and moisture, wherein said container may have a barrel structure and being formed by an elongated pot or cup having a closed bottom and an open top side, wherein the motor, an electronic control unit and batteries may be completely received within such cup element of the inner housing which, at its open top side, may be closed by means of a cover element which may form the front face of the barrel-like container forming the inner housing.

Thus, the barrel-like container forming the inner housing may have a two-piece structure comprising only two pieces, i.e. the aforementioned cup element and the cover element. Such two-piece structure of the inner housing considerably reduces sealing efforts necessary to make the container waterproof. In particular, it may be sufficient to use only one ring-shaped seal to seal the interface between the cup element and the cover element, wherein such interface may have a circular configuration although other contours such as oval or elliptical contours would be possible.

The aforementioned cup element may have an elongated configuration extending substantially over the entire length of the inner housing and may have a length corresponding to at least 80% or 90% of the inner housing and/or of the handle, whereas the cover element may have a length of smaller than 20% or smaller than 10% of the inner housing's length and/or the handle's length. Such cover element may have a disk-like or plate like configuration, wherein it may have a slightly dome-shaped or convex contour.

The connector elements of the housing for connection to the shaver head's support structure may be provided on the aforementioned cover element.

The cover element and the cup element of the inner housing may be rigidly connected to each other, wherein various known types of connection techniques such as form-fitting, screwing, welding, gluing and/or snap-fitting may be used.

So as to hold the motor and/or the electronic control unit and/or the batteries in position within the inner housing, a support frame to which the aforementioned components are attached, may be inserted into the cup element and may be held there in place, wherein for example a slide able guide element such as a guiding groove and/or guiding projections may be provided. Such support frame may be formed by or include a circuit board forming part of the electronic control unit. The shaft for driving the cutter unit may be rotatably supported by a bearing or a plurality of bearings attached to and/or formed by the cup element and/or the cover element of the inner housing.

So as to help in sealing the inner housing, the inner housing may have only one opening which may be an opening in the cover element through which the shaft protrudes. Optionally, there may be a second opening in an end portion opposite to the cover element which second opening may be provided for a charging connection. However, such second opening may be avoided by means of integrating the charging connectors into the inner housing, for example by means of molding charging pins to be an integral part of the inner housing.

So as to allow communication with the control unit inside the inner housing, the inner housing may include a soft material portion allowing to be deformed so as to activate switches positioned inside the inner housing. In addition or in the alternative, the inner housing may be provided with a display means for displaying information wherein such display element may be integrated into the inner housing by means of molding and/or form a part of the inner housing's surface.

So as to allow access to the aforementioned soft material portion associated with switching means of the inner housing, the outer housing also may have soft material portions and/or a recess or opening through which the soft material portion of the inner housing can be deformed. In addition or in the alternative, the outer housing may include a transparent portion covering the aforementioned display means of the inner housing so that such display means is visible through the transparent portion of the outer housing. In the alternative or in addition it also would be possible to provide the outer housing with a recess or opening through which the display can be seen.

The outer housing may have a two-piece or three-piece or multiple-piece shell structure comprising a plurality of shell elements that can be connected with each other and cover different portions of the inner housing. In particular, the outer housing may comprise two shell elements extending on opposite sides of the inner housing and connectable to each other. Such shell elements may have a substantially—roughly speaking—flute-like or chute-like contour so that the two shell elements together may surround the inner housing substantially completely.

In addition to such shell elements, the outer housing may further include a ring element to be connected with at least one of the aforementioned shell elements. Such ring element may help in forming a rigid, strong outer housing structure, wherein such ring element may be positioned at an end portion of the housing facing the shaver head. More particularly, such ring element may surround the shaft and may have an inner diameter which is significantly smaller than the maximum diameter of the inner housing.

Such inner ring may cover a ring portion of the cover element of the inner housing and/or may surround the inner housing's portion where the connector elements for connecting the shaver head's support structure are provided. Thus, such ring element may form the front face side of the outer housing facing the shaver head and therefore, may give the outer housing structure rigidity and strength in the region where the drive unit's shaft protrudes from the housing towards the shaver head.

Such housing structure may be the same for different shavers having different types of shaver heads. More particularly, the following shaver head structures may be attached to the housing: a first type of shaver head connected to the handle by means of a first support structure configured to provide for three-dimensional movements of the shaver head relative to the handle, a second type of shaver head connected to the handle by means of a second support structure configured to provide for only two-dimensional movements of the shaver head relative to the handle, and a third type of shaver head connected to the handle by a third support structure configured to rigidly hold the shaver head relative to the handle.

Thus, only one type of housing is manufactured, although different types of shaver heads and/or support structures are mounted to such housing.

According to a further aspect, the shaver handpiece has a housing accommodating a motor and rotatably supporting a drive shaft having a shaft portion extending outside of said housing, wherein said housing is provided with connector elements for connecting different types of shaver heads to the housing, wherein said housing includes an inner housing receiving the motor and an outer housing surrounding the inner housing, wherein said connector elements for connecting the shaver head are provided on said inner housing in a fixed, non-displaceable manner and include pivot joints providing for a pair of pivot axes extending transverse to the longitudinal axis of the drive shaft on opposite sides thereof. Such pivot joints are fixed in place at said inner housing, i.e. in fixed positions at a fixed distance from each other in fixed orientation, and allow for pivotably connecting link arms of a support structure configured providing for a pivot axis about which the shaver head may pivot relative to the handle. Nevertheless, such pivot axes do not need to be used, but is also possible to connect a more rigid structure such as a supporting yoke to such connector elements to block tilting movements of the shaver head.

In order to further improve ergonomics of the shaver and/or to allow for self-adjusting of the shaver head to the contour of the skin to be shaved, the aforementioned first and second types of support structure connecting the shaver head to the handle may be configured to allow for adjusting movements of the shaver head relative to the handle. In particular, the support structure may be configured to allow for slewing movements of the shaver head about at least one axis of rotation relative to the handle. For example, the support structure may be configured to provide for a tilting axis and/or a swiveling axis extending substantially perpendicular to the longitudinal axis of the handle so that the shaver head may tilt and/or swivel relative to the handle.

According to an aspect, the support structure of said first type of shaver head may include a four-joint linkage comprising at least two link arms which are, on the one hand, pivotably connected to the handle or a base part connected to the handle, and, on the other hand, pivotably connected to the shaver head, wherein the pivot axis connecting the link arms to the handle and the shaver head, respectively, may extend substantially parallel to each other.

For example, the link arms of the four-joint linkage may be arranged, when considering the shaver head in its neutral or non-rotated position, in a pitch roof-like or A-configuration where each of the link arms is slightly inclined towards a center plane containing the longitudinal axis of the handle and/or a center plane in the middle between the handle joints of the link arms and extending in parallel to the pivot axis going through such handle joints of the link arms. For example, the elongated link arms, with their longitudinal axis, may extend at an acute angle ranging from 5° to 45° or from 10° to 25° to such center plane, whereas, however, other configurations are possible.

If such tilting movements of the shaver head are not desired, a shaver head of a second type may be attached to the shaver's housing by means of a link arm structure including a pair of rigid link arms that may be a part of a rigid yoke so that the link arms no longer can pivot. Such link arm structure still may be connected to the aforementioned pivot joints provided on the cover element of the inner housing of the handle. In the alternative, it also would be possible to connect such rigid link arm structure or support structure to other connector elements provided on the cover elements of the inner housing. For example, such rigid structure may be fixed to the inner housing by means of screws.

Irrespective of the pivotable or rigid connection to the inner housing, the support structure of the shaver head still may include a swivel axis so as to allow swiveling movements of a cutter unit frame in which the cutter unit is supported about a swivel axis substantially parallel to the cutter oscillation axis.

If such swiveling movements of the shaver head are not desired either, it is then possible, to attach a third type of shaver head to the housing by means of an entirely rigid support structure not having any tilting axes and not having any swiveling axes. 'Entirely rigid' does not necessarily mean an absolutely rigid structure in terms of mechanical theory, but is to be understood in a more practical sense where materials do have restricted rigidities.

In order to have fewer restrictions on the varieties of shaver heads to be connected to the same type of handpiece, it may help to create some distance between the shaver head and the housing of the handpiece.

According to another aspect, the distance between the handle joints of the link arms may be larger than the distance between the head joints of the link arms, wherein the difference in the distances can be chosen differently. For example, the distance between the handle joints may be in the range from 105% to 200% or from 120% to 150% of the distance between the head joints, wherein, however, such difference in distances may vary with the length of the link arms.

Irrespective of the difference in distances between the handle points and head points of the link arms, the length of the link arms may be chosen rather short so as to allow for a compact arrangement of the shaver head relative to the handle. In particular, so as to combine a compact arrangement with a high stability of the support structure, the link arms each may have a length that is shorter than the distance between the handle joints of the link arms and/or shorter than the distance between the head joints of the link arms.

In order to help to allow for different architectures of the support structure, the shaver head has been moved away from the handle and positioned spaced apart therefrom so that a gap is formed between the shaver head's bottom face and the handle's top face which are facing each other, so that when, considering the shaver in its entirety, the outer contour of the shaver is provided with a significant, substantially ring-shaped or peripheral contraction between the shaver head and the end of the handle adjacent thereto, which contraction surrounds the aforementioned support structure which may be positioned in a center region of the handle's top face and the shaver head's bottom face, wherein ring-shaped does not necessarily mean a closed circle, but my include other contours such as an oval or elliptical ring which may or may not be closed or may be slotted. Said substantially ring shaped constriction may surround substantially completely a central neck portion. In other words, the shaver body has a neck formed between the handle and the shaver head clearly separating these two components from each other.

Due to such contraction and the aforementioned gap, substantially the entire bottom face of the shaver head and substantially the entire top face of the handle are uncovered and can be visible from the ambience. Contrary to previous shaver head designs where shaver head parts were penetrating into recesses in the handle or into the interior thereof and handle parts were interpenetrating into the shaver head, the separated bottom face of the shaver head and the top face of the handle can be more easily cleaned due to removal of such interpenetrating or interlacing parts. Moreover, the bottom face of the shaver head and the top face of the handle can have a smooth contour substantially without pockets or projections or edges and corners, thereby avoiding hairdust deposits on the shaver head's bottom face and the handle's top face.

The spacing between the shaver head's bottom face and the handle's top face may vary depending on where it is measured. According to another aspect, said gap, at its smallest section, may have a width of more than 3 mm or more than 5 mm or more than 10 mm, wherein said width corresponds to the distance of the bottom face of the shaver head from the top face of the handle. In particular, such width may be measured along an axis parallel to the handle's longitudinal axis, i.e. the aforementioned distance between the shaver head's bottom face and the handle's top face may be considered to be substantially parallel to the handle's longitudinal axis.

The aforementioned top face of the handle and the bottom face of the shaver each may have a convex, in particular dome-shaped contour and may be positioned relative to each other such that the aforementioned smallest width of the gap between the handle and the shaver head may be positioned in a center region of those top and bottom faces, for example close to a central longitudinal axis through the handle. Said width of the gap and/or the distance between the handle's top face and the shaver head's bottom face may continuously increase towards an outer periphery of these top and bottom faces. Such dome-shaped contour providing for a gap width decreasing towards the center of the shaver helps in cleaning the support structure and the inner portions of the top and bottom faces in a manner similar to a funnel increasing speed of blowing air or rinsing water.

In order to provide for an improved ergonomic handling of the shaver, the shaver head may have a functional surface inclined towards a front side of the handle at an acute angle to the longitudinal axis of the handle, wherein said acute angle may vary. For example, said acute angle may range from 45° to 85° or, for example, from 55° to 80°. Such inclination makes it easier to hold the shaver with said functional surface parallel to the skin to be shaved without angling the hand or the arm in a non-natural position. The aforementioned functional surface is the shaver head's surface where the at least one cutter unit is positioned, wherein, for example, a pair of such elongated cutter units may be positioned parallel to each other on such functional surface. Additional functional elements such as a long hair cutter and/or a cooling element and/or a lubrication element also may be positioned on such functional surface, wherein, for example, a long hair cutter may be positioned between a pair of cutting units or along a side thereof.

The aforementioned front side of the handle, towards which the shaver head, with its functional surface, is inclined, may be considered to be side of the handle which remains open or untouched when the handle is grabbed by hand and/or which faces the user grabbing and watching the shaver. Usually, at least one operating key such as an on/off key or switch may be positioned on such front side of the handle.

When considering the handle in its entirety, the handle may have an elongated shape the cross-section of which may substantially continuously increase from a bottom face of the handle to a top face of the handle opposite to said bottom face of the handle. In other words, the cross-section of the handle may continuously increase towards the shaver head. The cross-sectional shape may vary, wherein such cross-sectional shape may be substantially rounded and/or circular and/or elliptical and/or oval. "Substantially continuously" does not exclude some portions such as a display portion or an operating key portion where the cross-section does not increase. Nevertheless, when considering the larger proportions, the handle's cross-section may increase from a bottom end portion to a top end portion.

The shaver head's support structure, at least in part, may be uncovered and/or freely accessible via said gap between the shaver head and the handle. Such uncovered arrangement allows for easy cleaning of the link arms to remove hair stubbles and deposits which could impair movability of those link arms.

In addition, the drive transmitter may include a shaft or shaft-like elongated drive element extending from the handle into the interior of the shaver head. Such drive transmitter may be uncovered at least partially or it may be received within a sleeve-like, elongated transmitter housing extending through said gap.

Thus, when the support structure includes the aforementioned pair of link arms, three elements may bridge the handle and shaver head, namely said pair of link arms and the drive transmitter. According to an aspect, said drive transmitter may extend separately and spaced apart from said link arms through the gap between the handle and the shaver head to allow for cleaning of each of those elements. So as to achieve a compact arrangement of these three separate elements, the drive transmitter may be arranged in the middle or center between said pair of link arms. However, the drive transmitter also may be offset from the plane containing the link arms.

The drive train passing the support structure, in particular the aforementioned four-joint linkage, may extend in a central region of the handle and/or shaver head, wherein it may extend through a region between the aforementioned link arms of the four-joint linkage. In other words, the link arms may be positioned on opposite sides of the drive train and/or may sandwich the aforementioned drive shaft or elongated transmitter between them. In the alternative, the link arms can be provided on one side of the drive train or transmitter. For example, the link arms may be offset in the direction of the axis of rotation defined by the link arms so that the drive train passes the support structure on one side of the link arms. In addition or in the alternative, the link arms also could be offset relative to such transmitter in a direction perpendicular to the axis of rotation defined by the link arms.

So as to transform the rotatory oscillation of such shaft as mentioned before into a linear oscillation of the at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

These and other features become more apparent from the examples shown in the drawings. As can be seen from FIG. 1, shaver 1 may have a shaver housing 300 forming a handle 2 for holding the shaver, which handle may have different shapes such as—roughly speaking—a substantially cylindrical shape or box shape or bone shape allowing for ergonomically grabbing or holding the shaver, wherein such shaver handle 2 has a longitudinal axis 20 due to the elongated shape of the handle, cf. FIG. 1.

More particularly, the handle 2 may have a cross-sectional shape which is rounded or circular or oval or elliptical, wherein mixtures of those shapes are possible. Irrespective of the cross-sectional shape, the cross-section may continuously increase from one end of the handle to the other one thereof.

On one end of the handle 2, a shaver head 3 is attached to the handle 2, wherein, in a first configuration, the shaver head 3 may be slewably supported about a swiveling axis 7 and about a tilting axis 11 which swiveling and tilting axes 7 and 11 may extend substantially perpendicular to each other and perpendicular to the aforementioned longitudinal handle axis 20.

When considering an oblong main axis 40 of the shaver head 3, the swivel axis 7 may extend parallel to such main axis 40, whereas the tilting axis 11 may extend perpendicular to such main axis 40. Such main axis 40 may be considered to extend in parallel to the larger side surfaces of the shaver head 3 and/or in parallel with a longitudinal axis of the elongated cutter elements 4 and/or in parallel with a cutter oscillation axis 8 and/or substantially perpendicular to the longitudinal handle axis 20. As can be seen from FIG. 1, the shaver head 3 may have a—roughly speaking—elongated box-like shape with a pair of larger side surfaces 55 and 57 arranged on opposite sides of the functional surface 56 which is facing away from handle 2. As can be seen from FIG. 1, the aforementioned box shape of the shaver head 3 does not mean—at least not necessarily—a mathematical cuboid or parallelepiped, but may include rounded edges and/or rounded corners and/or slightly convex and/or concave surfaces.

The shaver head 3 may include a pair of elongated cutter units 100 each comprising an elongated cutter element 4 that can be driven in a reciprocating manner along reciprocating axis 8 which may extend parallel to the aforementioned main axis 40. Said cutter elements 4 may cooperate with and reciprocate under shear foils 5 covering said cutter elements 4.

The said cutter elements 4 may be supported movably relative to the shaver head 3 or, more particularly, relative to a shaver head frame 6 such that, on the one hand, the cutter elements 4 may swivel and tilt together with the shaver head 3 about swiveling and tilting axes 7 and 11 and, on the other hand, the cutter elements 4 may oscillate along a cutting or reciprocating axis 8 relative to the shaver head frame 6, wherein said reciprocating axis 8 may extend parallel to the longitudinal axis of the elongated cutter elements 4. In addition to these degrees of freedom, the cutter elements 4 may be movable relative to the shaver head frame 6 along and/or about additional axes. For example, the cutter elements 4 may dive into the shaver head 3, i.e. displaced along an axis substantially parallel to the longitudinal handle axis 20 when the shaver head 3 is in a position aligned therewith.

The shaver head 3 may include further functional elements such as a long hair cutter which may be arranged between the aforementioned pair of cutter elements 4 or along a side thereof. Furthermore, it should be said that in addition to or in the alternative to the aforementioned elongated cutter elements 4 oscillating linearly, it also would be possible to provide for cutter elements of the rotatory type which may rotate or rotatorily oscillate.

As mentioned before, the cross-section of the handle 2 may increase from one end to the other end thereof. More particularly, the cross-section may become larger towards the shaver head 3, wherein the cross-section may continuously and/or slightly increase from the bottom face 207 to the top face 202 of the handle.

Figure 5A:
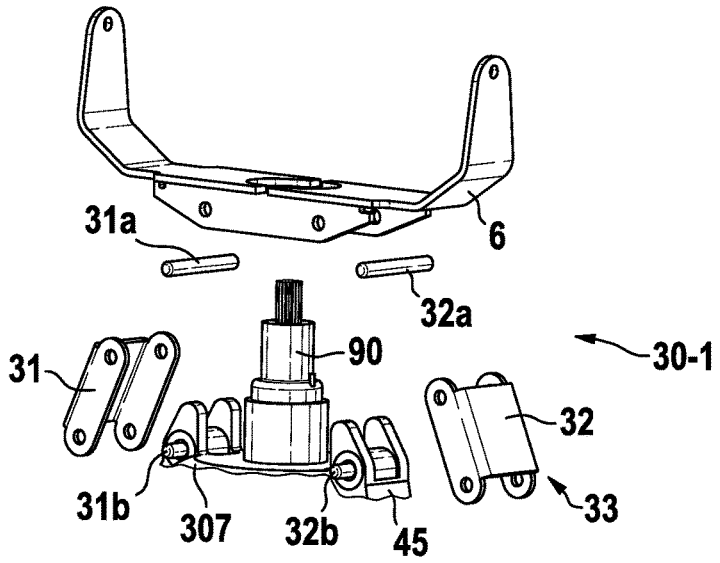
FIG. 5*a*-5*c*: a perspective explosion view of the different support structures the shaver heads, wherein partial view (a) illustrates a support structure allowing the shaver head to swivel and tilt, partial view (b) illustrates a support structure allowing the shaver head to swivel and partial view (c) illustrates a support structure which fixedly attaches the shaver head to the handle and FIG. 6 a schematic perspective view of the disassembled shaver.

As can be seen from FIGS. 1 to 3, the shaver head 3 is supported onto the handle 2 by means of a support structure 30 which, in a first configuration, may include a four-joint linkage 33 which may comprise a pair of link arms 31 and 32 that may pivot about parallel axes. Such link arms 31 and 32 may have a bar-shaped or a frame-like structure including a U-shaped cross-section as it is shown in FIG. 5*a*.

Said link arms 31 and 32 are arranged in an upright, standing configuration where the end portions of those link arms 31 and 32 connected to the shaver head 3 are further away from the handle 2 than the opposite end portions of those link arms 31 and 32 connected to the handle 2 or a base part 45 connected to such handle 2. In other words, when considering the shaver 1 in an upright position with the shaver head 3 above the handle 2, upper end portions of the link arms 31 and 32 are connected to a shaver head part, whereas lower end portions of the link arms 31 and 32 are connected to the handle 2 or a base part mounted thereon.

In a neutral or non-tilted position of the shaver head 3 where the main axis 40 of shaver head 3 extends substantially perpendicular to the longitudinal handle axis 20, the link arms 31 and 32 may be arranged symmetrical with regard to a center plane containing the longitudinal handle axis 20, cf. FIG. 2 (*a*). More particularly, the link arms 31 and 32 may be inclined relative to such center plane at an acute angle.

As can be seen from FIGS. 2 and 3, the handle joints 31*b* and 32*b* where the link arms 31 and 32 are pivotably connected to the handle 2 or base part 45 are spaced from each other at a distance L1 that is larger than the distance between the head joints 31*a* and 32*a* where the link arms 31 and 32 are pivotably connected to the shaver head part. The ratio between distance L1 to distance L2 may vary and/or may be adapted to the length of the link arms 31 and 32 so as to achieve the desired kinematics as explained before.

Figure 2A:
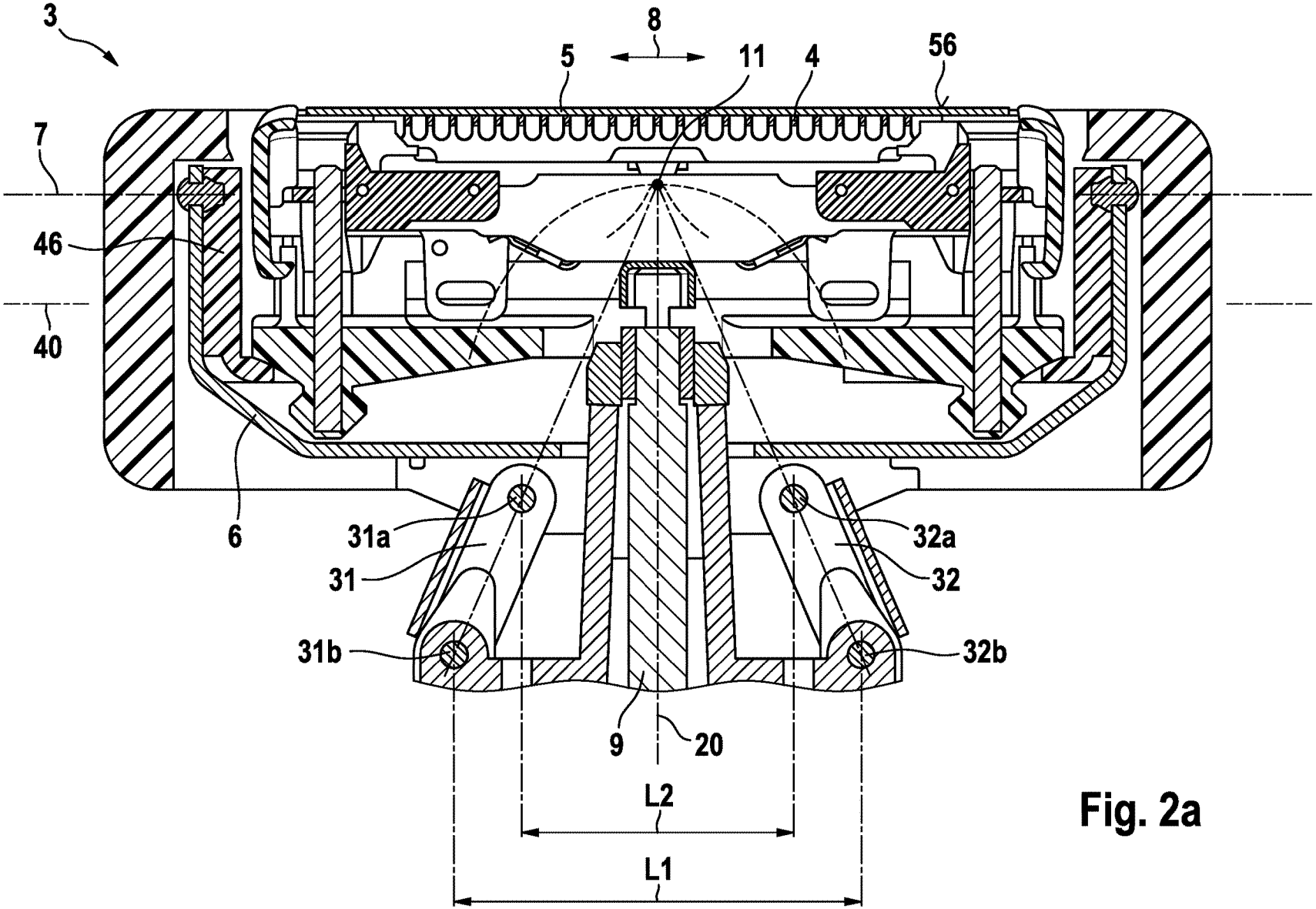
FIG. 2*a*-2*b*: a cross-sectional view of the shaver head and the support structure thereof, wherein partial views (a) and (b) show the shaver head in a different tilting positions to illustrate the tilting allowed by a first one of the support structures of the shaver heads.
Figure 2B:
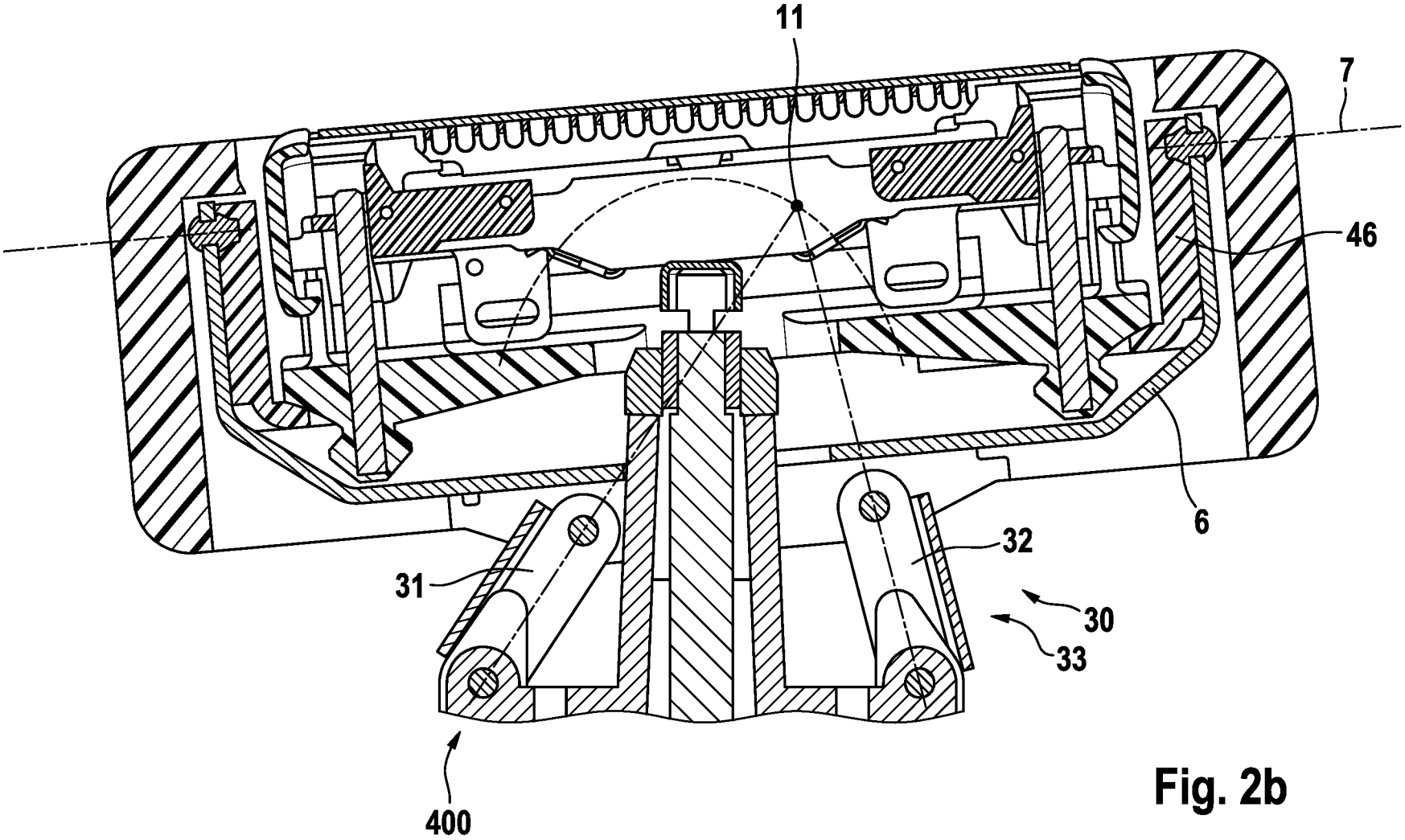

As can be seen from FIGS. 2*a* and 2*b*, a shaver head frame 6 may be connected to the link arms 31 and 32 at the head joints 31*a* and 32*a* thereof which define pivot axes parallel to tilting axes 11. Consequently, the shaver head frame 6 may tilt relative to the handle 2 about said tilting axis 11.

Furthermore, said shaver head frame 6 may pivotably support another shaver head part such as a cutter support frame 46 to allow such cutter support frame 46 to swivel about a swivel axis 7 defined by a pivot bearing 34 between the shaver head frame 6 and the cutter support frame 46. Such pivot bearing 34 may include a shaft or stubble received within a hole or recess, wherein the swivel axis 7 may be fixed relative to the shaver head frame 6.

Figure 3A:
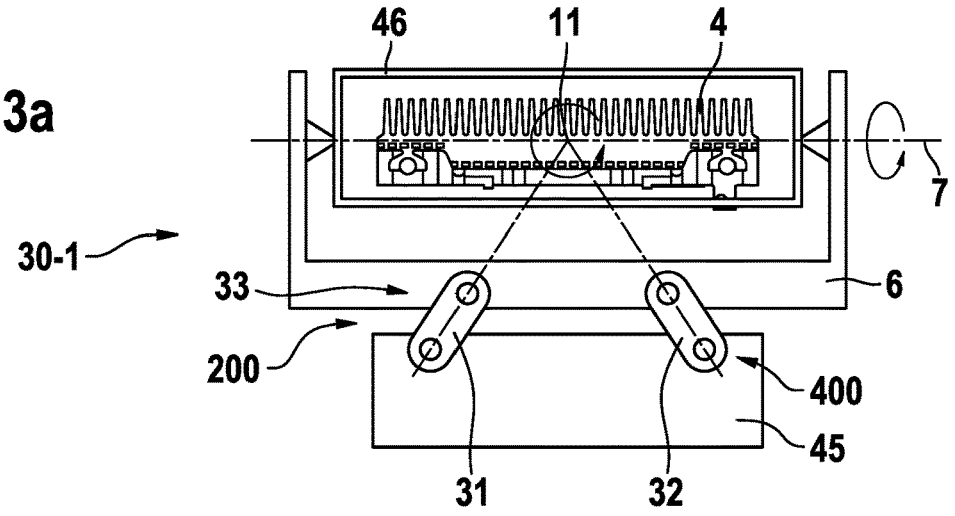
FIG. 3*a*-3*c*: a more schematic view of the different support structures of the shaver heads to illustrate the different kinematics thereof, wherein partial view (a) illustrates a support structure allowing the shaver head to swivel and tilt, partial view (b) illustrates a support structure allowing the shaver head to swivel and partial view (c) illustrates a support structure which fixedly attaches the shaver head to the handle.
Figure 3B:
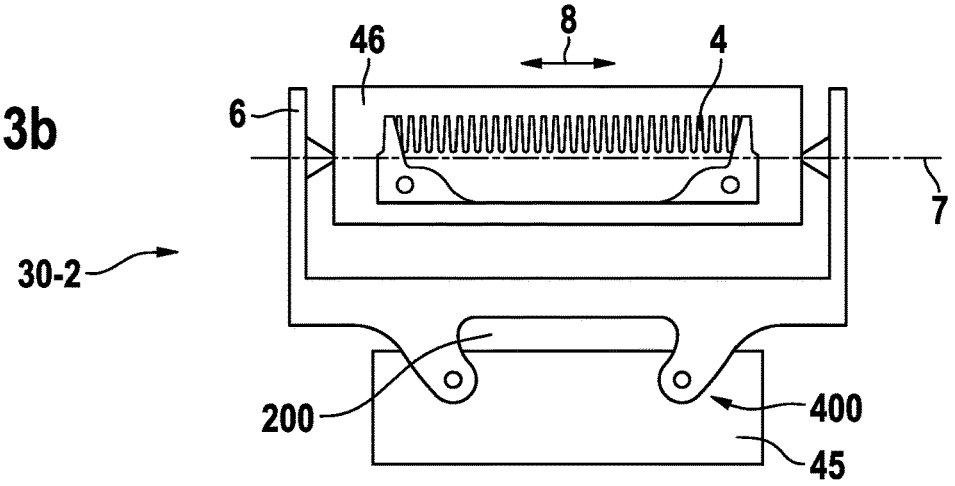
Figure 5B:
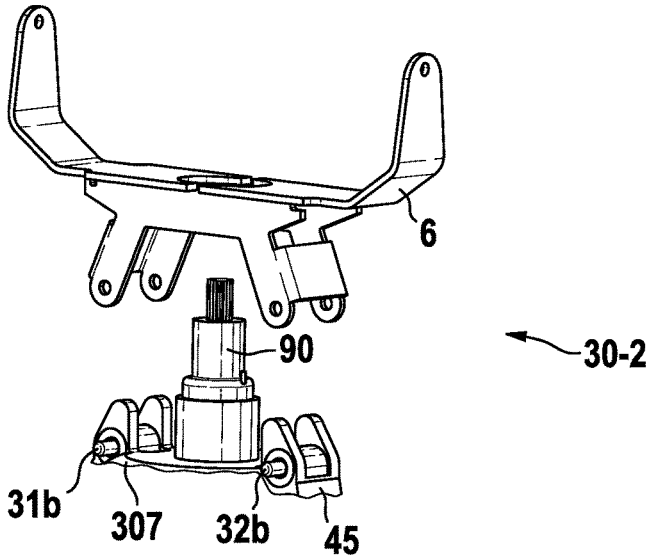

Contrary to such first configuration shown in FIG. 3*a* and FIG. 5*a*, different types of shaver heads may be attached to the handle 2. For example, according to a second configuration shown in FIGS. 3*b* and 5*b*, the tilting axis 11 may be eliminated what can be achieved, for example, by means of attaching the aforementioned link arms 31 and 32 rigidly to the shaver head frame 6, cf. FIG. 5*b*. Thus, the link arms 31 and 32 still can be pivotably connected to the shaver's housing 300 by means of the aforementioned handle joints 31*b* and 32*b*. Nevertheless, the shaver head may not pivot, because the link arms 31 and 32 form an integral, rigid part of the shaver head frame 6. Such shaver head frame 6 still may pivotably support the aforementioned cutter unit frame 46 so as to allow swiveling.

In the alternative, it also would be possible to eliminate the swiveling axes, but still to provide for the tilting axes. This could be achieved, for example, by means of rigidly connecting the cutter unit support frame 46 to the shaver head frame 6, wherein said shaver head frame 6 is connected to the handle 2 by means of the support structure 30 in terms of the four-joint linkage shown in FIGS. 3*a* and 5*a*.

Figure 3C:
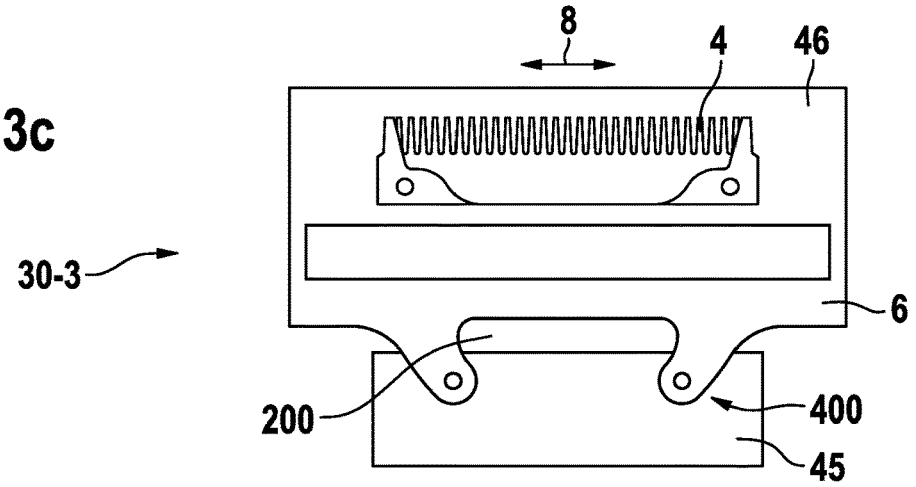
Figure 5C:
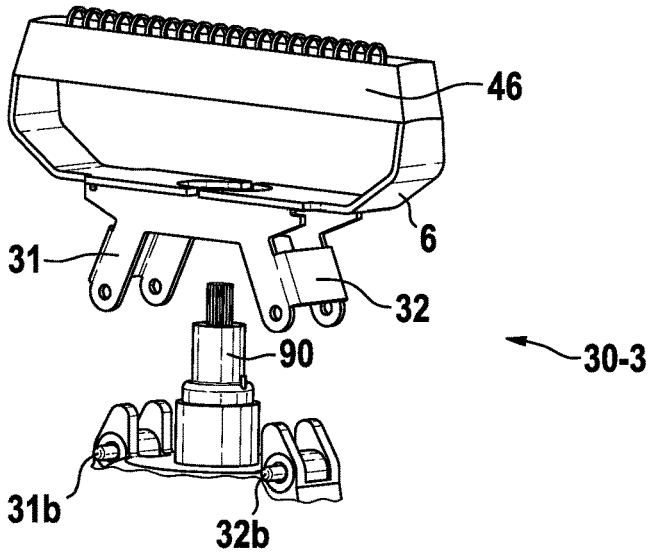

According to another possible configuration of the shaver head 3, the support structure 30 can be substantially rigid or can completely lack any tilting and swiveling axes, as it is shown in FIGS. 3*c* and 5*c*. The cutter unit support frame 46 is rigidly attached to the shaver head frame 6 which again is rigidly attached to the housing by means of a pair of rigid link arms 31 and 32, cf. FIG. 5*c*.

The aforementioned cutter element 4 may be supported at the cutter support frame 46, wherein the cutter elements 4 may be allowed to execute the aforementioned reciprocating drive movements along reciprocating axis 8 relative to the cutter support frame 46. In addition, the cutter elements 4 may dive relative to such cutter support frame 46 towards the handle 2.

As can be seen from FIG. 1, the link arms 31 and 32 are uncovered and accessible from the ambience as the shaver head 3 is positioned spaced apart from the handle 2. More particularly, the shaver head 3 is separated and spaced apart from the handle such that a gap 200 is defined between a bottom face 201 of the shaver head and a top face 202 of the handle 2, wherein said gap 200 forms a substantially ring-shaped or peripheral contraction in the outer contour of the shaver 1 around the link arms 31 and 32 so that access to such link arms 31 and 32 is given from the ambience. Thus, a user may watch the link arms 31 and 32 moving when the shaver head 3 is tilting or slewing.

Figure 4:
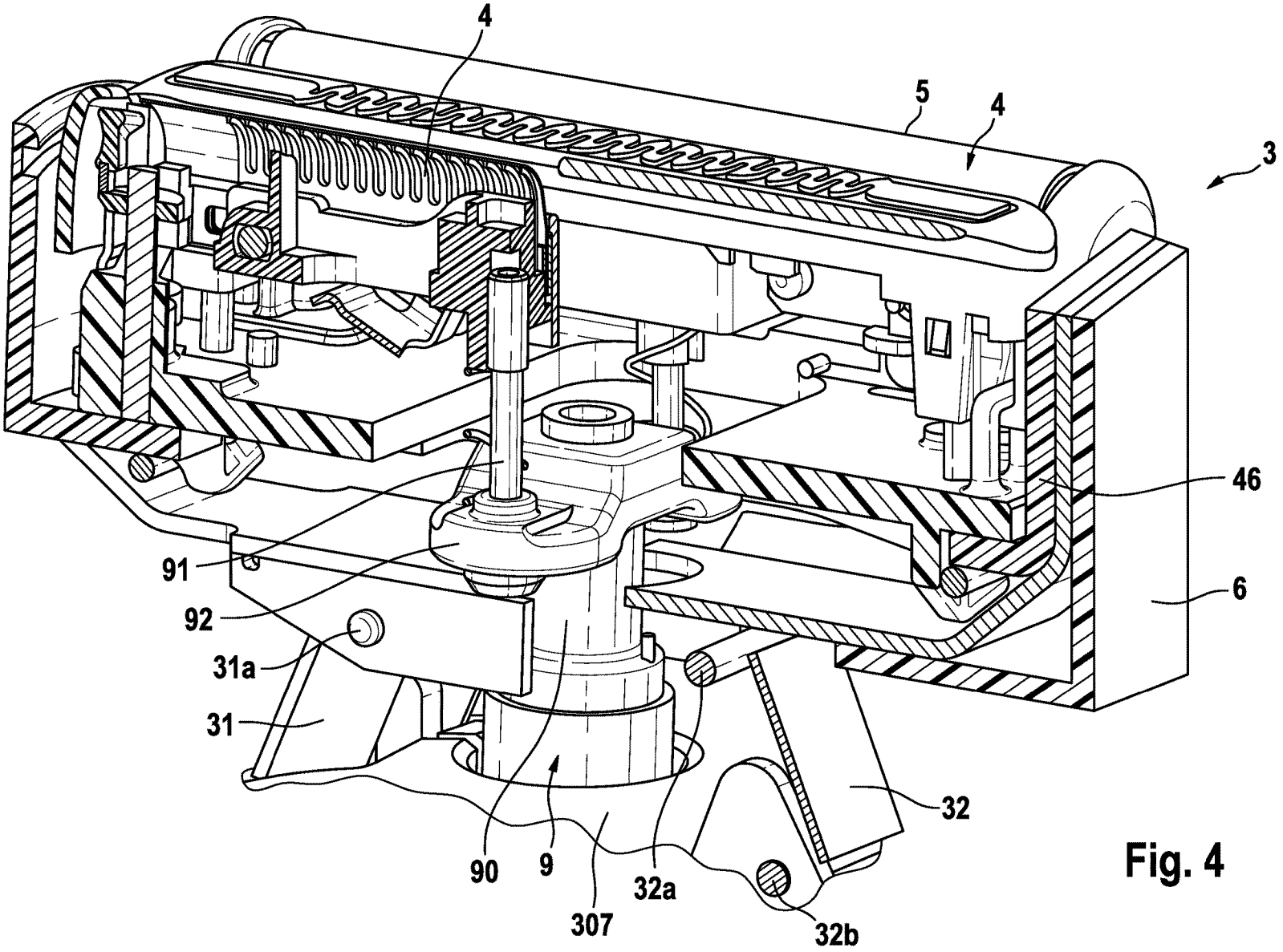
FIG. 4: a perspective cross-sectional view of the shaver head and the support structure thereof, showing the link arms of the four-joint linkage and the drive shaft extending from the handle through the support structure into the shaver head so as to drive the cutter elements in a reciprocating manner.

In addition to said link arms 31 and 32, an elongated drive transmitter 9 may extend from the handle 2 into the shaver head 3 so as to connect the cutter element 4 to a motor 93 which may be accommodated in the interior of the handle 2. Such elongated drive transmitter 9 may include a shaft 90 which may be driven to rotate in a reciprocating manner, i.e. to rotate back and forth by a certain degree. As can be seen from FIG. 4, a crank element 92 may be rotatorily fixed to said shaft 9 and accommodated inside the shaver head 3. Such crank element may rigidly support a drive pin 91 for each of said cutter elements 4. Said crank element, in a neutral position of the shaft 9 may extend transverse to the longitudinal axis of the elongated cutter element 4 so that the drive pin 91 moves back and forth along the longitudinal axis of the cutter element 4. More particularly, such drive pin 91 executes a movement along a segment of a circle. However, as the rotational oscillation has limited amplitude and the circular segment is tangential to the longitudinal axis of the cutter element 4, such movement may be considered to approximate a linear movement along the cutter element's longitudinal axis.

The aforementioned elongated drive transmitter 9 in terms of the aforementioned shaft 90 may extend through the gap 200 separate from the link arms 31 and 32. Thus, three separate elements spaced apart from each other may bridge the aforementioned gap 200, namely the link arms 31 and 32 and the elongated drive transmitter 9.

The link arms 31 and 32 and the drive transmitter 9 together form a neck 203 connecting the handle 2 to the shaver head 3, which neck 203 is surrounded by said gap 200 and has a cross-sectional area significantly smaller than the cross-sectional area of the handle 2 and/or of the shaver head 3 when considering a cross-sectional plane transverse to the longitudinal axis 20 of the handle 2.

As can be seen from FIG. 1, the top face 202 of the handle 2 and the bottom face 201 of the shaver head 3 each may have a dome-shaped contour so that the aforementioned gap 200 may have its smallest width in the center of those dome-shaped bottom and top faces, wherein the width of the gap 200 may continuously increase towards the outer periphery of said bottom face 201 and/or top face 202. The smallest width of the gap 200 may be positioned between the link arms 31 and 32 and/or the transmitter 9 and said link arms 31 and 32, and/or in a center region of the shaver.

Said smallest width of the gap 200 in the center thereof may be at least 3 mm or at least 5 mm.

Figure 6:
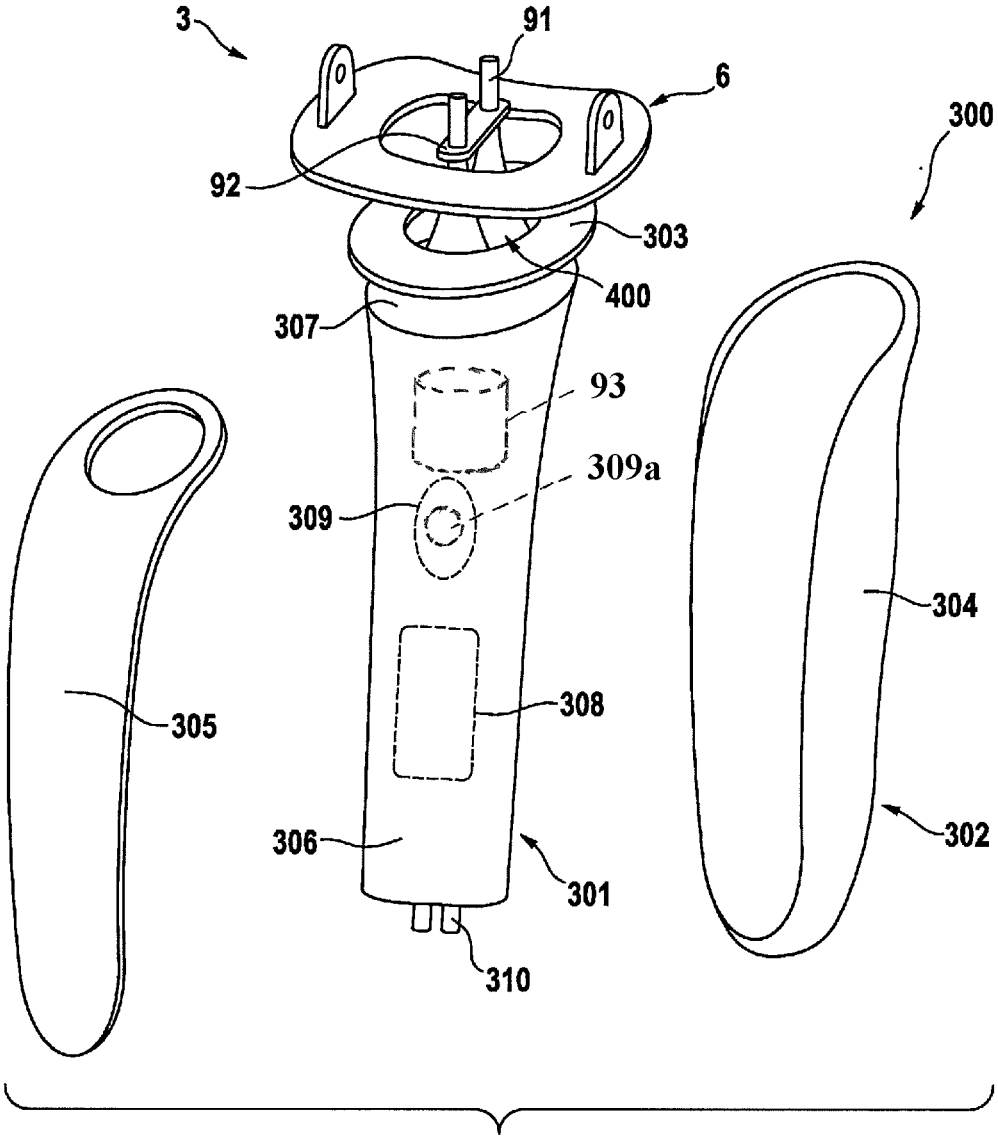

As can be seen from FIG. 6, the housing 300 forming the handle 2 may have a two-shell structure comprising an inner housing 301 and an outer housing 302 surrounding said inner housing 301.

The inner housing 301 accommodates the aforementioned motor 93 and furthermore, an electrical storage such as batteries or an accumulator, and an electronic control unit, wherein the inner housing 301 may form a water-tight container protecting such components from liquids and moisture. The inner housing 301 may be provided with a gas venting opening in order to allow battery gases to vent in case of need. Said gas venting is provided such that water can not enter inside the inner housing (e.g. by a gore tex membrane or other valve or membrane with similar effect).

More particularly, the inner housing 301 may have an elongated barrel-like structure including a cup or pot element 306 having a closed bottom and an open top face, wherein such cup element may extend substantially over the entire length of the handle 2, cf. FIG. 6.

The cup element 306 is closed, at its open top side, by a cover element 307 which may have a plate-like or slightly dome-like shape and, when closing the cup element 306, forms a front face side of the inner housing 301 facing the shaver head 3.

The aforementioned cover element 307 includes an opening through which the shaft 90 penetrates the housing, wherein the cover element 307 is sealed, by means of appropriate seals, against said shaft 90 and against the cover element 307 so that the inner housing 301 forms a waterproof container.

As can be seen from FIG. 6, charging connections such as charging pins 310 may protrude from the bottom side of the cover element 307 so as to allow charging of the batteries inside the inner housing 301. The charging pins are preferably over injection molded by the bottom portion of the inner housing 301 in order to provide a water tight connection.

The inner housing 301 may include at least one soft thermoplastic material portion 309 which can be associated with an electronic switching means 309*a* inside the inner housing 301. In addition or in the alternative, the inner housing 301 may be provided with a display element 308 which may include light sources such as LEDs to display information, wherein such display element 308 may be controlled by the electronic control unit.

As can be seen from FIG. 6, the outer housing 302 may have a shell structure including a pair of elongated shell elements 304 and 305 which together may surround the inner housing 301 substantially entirely. The shell elements 304 and 305 may extend substantially over the entire length of the inner housing 301 and/or the handle 2.

Said shell elements 304 and 305 may be positioned on opposite sides of the inner housing 301 and may be connected to each other so that they together form the gripping surface of the substantially cone-shaped or cylindrical handle 2.

In addition, the outer housing 302 may include a ring element 303 forming, at least in part, a top side surface of the outer housing 302 facing the shaver head 3, wherein said ring element 303 may have an inner diameter substantially smaller than the maximum outer diameter of the inner housing 301. Said ring element 303 is connected to at least one of the shell elements 304 and 305 and may cover a ring-shaped portion of the cover element 307 of the inner housing 301.

More particularly, the ring element 303 may surround a central portion of the cover element 307 of the inner housing 301 where the connections elements 400 for connecting the support structure 30 of the various shaver heads 3 to the housing 300. Such connector elements 400 may include, as described above, the pivot joints or handle joints 31*b* and 32*b*.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaver set comprising:

a plurality of electric shavers, each shaver comprising:

a handle comprising a housing, a motor received in said housing, a shaver head connected to said handle by a support structure mounted to connector elements of said housing, at least one cutter unit provided on said shaver head and including a cutter element and a shearfoil, wherein said cutter element is configured to be driven along a cutter oscillation axis by said motor via a drive transmitter extending from said housing, past the connector elements of said housing and into the support structure connecting said motor to said cutter element, wherein the housings of all electric shavers including the drive transmitters supported by said housings and the connector elements of said housings are identical to each other, wherein the identical structure of the connector elements of all housings matches with the support structure of each shaver head, wherein the shaver heads and the support structure thereof are different from each other, wherein the following three types of support structures are included:

a first support structure configured to provide for a swivel axis and a tilting axis about which a corresponding said shaver head may swivel and tilt relative to said associated handle, a second support structure configured to provide for only a swivel axis about which a corresponding said shaver head may swivel relative to said associated handle, and a third support structure configured to rigidly hold a corresponding said shaver head relative to said associated handle.

2. The shaver set according to claim 1, wherein each of said first, second and third support structures include a pair of link arms connected to the connector elements of the housing of the associated handle, said connector elements forming joints providing for pivot axes extending transverse to the longitudinal axis of the handle, wherein the link arms of said first support structure are pivotably connected to a shaver head frame by head joints providing for pivot axes extending substantially parallel to the pivot axes provided by the connector elements of the housing, thus forming a four-joint linkage for tiltably supporting said head frame about said tilting axis, wherein said shaver head frame pivotably supports a cutter support frame about said swivel axis, said cutter support frame supporting the at least one cutter unit, the link arms of said second support structure are rigidly connected to a shaver head frame, said shaver head frame pivotably supporting a cutter support frame about said swivel axis, said cutter support frame supporting said at least one cutter unit, and the link arms of said third support structure are rigidly connected to a shaver head frame to which a cutter support frame is rigidly connected, said cutter support frame supporting said at least one cutter unit.

3. The shaver set according to claim 2, wherein said link arms are mounted in a standing configuration with connection points of the link arms being connected with the shaver head so as to be further away from the handle than connection points of the link arms which are connected with the handle, wherein said link arms are uncovered and freely accessible between the handle and the shaver head with said link arms being visible to a user.

4. The shaver set according to claim 1, wherein the shaver head of each of the electric shavers is positioned spaced apart from the associated handle with a gap defined between a bottom face of the shaver head and a top face of the handle, said gap forming a peripheral contraction in the outer contour of the shaver around the support structure and giving access to the support structure bridging the gap, wherein said gap, at its smallest section, has a width of more than about 3 mm, said width corresponding to the distance of the bottom face of the shaver head from the top face of the handle.

5. The shaver set according to claim 1, wherein, in each of said shavers, the drive transmitter includes a shaft having a shaft portion extending out of the housing and supporting a crank element to which at least one drive pin is rigidly connected, wherein said shaft, said crank element and said drive pin form a rigid structure with the drive pin defining a longitudinal axis holding a fixed orientation relative to the handle, and wherein, in each shaver head, the cutter element of the at least one cutter unit includes a drive pin recess in which the drive pin is received fixedly in the direction of the cutter oscillation axis.

6. A method of manufacturing a shaver set comprising a plurality of electric shavers, each shaver comprising a handle having a housing, a shaver head including at least one cutter unit comprising a shearfoil and a cutter element drivable under said shearfoil along a cutter oscillation axis, and a motor connected to said cutter element via a drive transmitter, the method comprising:

a) manufacturing, for each of said electric shavers, a corresponding said housing for containing the motor and supporting the drive transmitter, the drive transmitter extending from said housing, past connector elements of said housing and into a support structure for a corresponding said shaver head, a portion of said housings containing and fully enveloping the motor and supporting the drive transmitter, being identical to each other and having the connector elements for connecting the support structure of each of the shaver heads to said housing, with all housings of all shavers of the shaver set having the identical structure of connector elements, b) manufacturing, for each of the electric shavers, a support structure for connecting the shaver head to said housing, wherein said support structures include the following three support structures:

a first support structure configured to provide for a swivel axis and a tilting axis about which said corresponding shaver head may swivel and tilt relative to said associated housing, a second support structure configured to provide for a swivel axis about which said corresponding shaver head may swivel relative to said associated handle, and a third support structure configured to rigidly hold the corresponding shaver head non-moveable relative to the associated housing, wherein the support structures of all shaver heads are manufactured to match the connector elements of all housings of all electric shavers of the shaver set.

7. The method according to claim 6, wherein said housing includes an inner housing portion for receiving said motor and an outer housing portion surrounding said inner housing portion.

8. A shaver handpiece of an electric shaver, wherein said shaver handpiece comprising a handle having a housing, a motor received in said housing, a drive transmitter connected to said motor and including a drive shaft having a shaft portion extending outside of said housing, said shaft is driven by said motor to rotate in a reciprocating manner, wherein said housing is provided with connector elements for connecting a shaver head to the handle, wherein said housing comprises an inner housing portion receiving said motor and an outer housing portion surrounding said inner housing portion, the outer housing portion comprising shell elements positioned on opposite sides of the inner housing portion, wherein said connector elements for connecting the shaver head are provided on said inner housing portion and include joints providing for a pair of pivot axes extending transverse to the longitudinal axis of the drive shaft and positioned on opposite sides of the drive shaft, wherein said joints are positioned in place at said inner housing portion.

9. The shaver handpiece according to claim 8, wherein said handle has an elongated shape the cross-section of which continuously increases from a bottom portion toward a top portion opposite to said bottom portion.

10. The shaver handpiece according to claim 8, wherein said drive transmitter further includes a crank element rigidly connected to said shaft and at least one drive pin rigidly connected to said crank element and defining a longitudinal drive pin axis having a fixed orientation relative to the handle, wherein said crank element and said drive pin are positioned outside the inner housing portion and the outer housing portion.

11. The shaver handpiece according to claim 8, wherein said outer housing portion includes a ring element surrounding said shaft and having an inner diameter which is smaller than a maximum diameter of the inner housing portion, said ring element being positioned at an end portion of the handle where the shaft penetrates the inner housing portion, said outer housing portion shell elements to be connected to each other, wherein at least one of said shell elements is to be connected to said ring element.

12. The shaver handpiece according to claim 8, wherein said inner housing portion is only provided with a first opening for the shaft of the drive.

13. The shaver handpiece according to claim 8, wherein said inner housing portion is provided with at least one soft material portion which is associated with a switching element arranged inside said inner housing portion.

* * * * *